United States Patent [19]

Quennessen

[11] Patent Number: 4,860,920

[45] Date of Patent: Aug. 29, 1989

[54] COSMETICS BOX WITH IMPROVED CLOSING MEANS

[75] Inventor: Rene Quennessen, Creteil, France

[73] Assignee: AMS Packaging, Saint-Ouen-L'aumone, France

[21] Appl. No.: 116,321

[22] Filed: Nov. 2, 1987

[30] Foreign Application Priority Data

Nov. 3, 1986 [FR] France ..... 86 15275

[51] Int. Cl.[4] ..... B65D 43/22; B65D 43/24

[52] U.S. Cl. ..... 220/326; 16/297; 206/1.5; 206/581; 220/263; 220/335; 220/DIG. 26

[58] Field of Search ..... 206/235, 581, 1.5; 220/334, 335, 262–264, DIG. 26, 326; 16/297, 324, 325, 326, 332, 343, 349, 350

[56] References Cited

U.S. PATENT DOCUMENTS

| | | | |
|---|---|---|---|
| 1,856,035 | 4/1932 | Weil | 220/DIG. 26 |
| 1,987,533 | 1/1935 | Kreisler | 220/DIG. 26 |
| 2,003,355 | 6/1935 | Farkas | 220/326 |
| 2,377,717 | 6/1945 | Reilly | 220/DIG. 26 |
| 2,654,503 | 10/1953 | Parsell | 220/335 |
| 3,308,835 | 3/1967 | Silverberg | 220/326 X |

FOREIGN PATENT DOCUMENTS

| | | |
|---|---|---|
| 0036828 | 3/1981 | European Pat. Off. . |
| 0081901 | 10/1982 | European Pat. Off. . |
| 2053956 | 4/1971 | France . |
| 2338671 | 8/1977 | France . |
| 2382869 | 10/1978 | France . |
| 2411942 | 7/1979 | France . |
| 2412474 | 7/1979 | France . |
| 2454284 | 11/1980 | France . |
| 2458243 | 1/1981 | France . |
| 2460850 | 1/1981 | France . |
| 2471326 | 6/1981 | France . |
| 2472517 | 7/1981 | France . |
| 2488109 | 2/1982 | France . |
| 2511233 | 2/1983 | France . |
| 2511584 | 2/1983 | France . |
| 2512484 | 3/1983 | France . |
| 2512650 | 3/1983 | France . |
| 2505632 | 4/1983 | France . |
| 2517528 | 6/1983 | France . |
| 2534787 | 4/1984 | France . |
| 2535957 | 5/1984 | France . |
| 2538230 | 6/1984 | France . |
| 2543412 | 10/1984 | France . |
| 2546137 | 11/1984 | France . |
| 2546386 | 11/1984 | France . |
| 2549355 | 1/1985 | France . |
| 2560507 | 9/1985 | France . |
| 2561882 | 10/1985 | France . |
| 2494970 | 3/1986 | France . |
| 2527058 | 4/1986 | France . |

*Primary Examiner*—Bryon P. Gehman

*Attorney, Agent, or Firm*—Mason, Fenwick & Lawrence

[57] ABSTRACT

A box for cosmetics comprising a base defining a recess, a cover pivotably mounted on the base around a rear transverse pivot, a movable push rod borne by the base at the rear end cooperating with the cover so as to open it, and a pair of parts cooperating and movable with respect to one another for resiliently holding the cover in the closed position. The pair of parts are complementary in shape with one another, the first part comprising a portion of the cover and the second part comprising a portion of the base, so that the push rod functions mainly to open the cover and not to lock it in the closed position.

4 Claims, 2 Drawing Sheets

COSMETICS BOX WITH IMPROVED CLOSING MEANS

BACKGROUND OF THE INVENTION

1. Field of Invention

The invention relates to a box, inter alia for cosmetics such as make-up.

2. Description of Prior Art

Most make-up boxes comprise a base at the bottom defining an upper recess for containing cosmetic products (make-up, power, etc.) and/or accessories (brushes, pencils etc.) and also comprise a top cover pivotably mounted on the base around a usually transverse rear pivot, between a closed position and an open position. The main purpose of the cover is to close the recess containing the cosmetic products and accessories so as to protect them and hold them in position. The cover may also be adapted to bear a mirror in its inner surface. When closed, the cover is pressed against the base, whereas when open it is usually at least substantially perpendicular to the base and extending upwards, the base being approximately horizontal.

In a first and commonest embodiment, the box also comprises a clasp, catch or the like disposed on the front transverse edge (French Patents No. 2 382 869, 2 411 942, 2 412 474, 2 454 284, 2 458 243, 2 471 326, 2 472 517, 2 488 109, 2 505 632, 2 511 233, 2 511 584, 2 512 650, 2 527 058, 2 543 412, 2 546 137, 2 546 386, 2 560 507, 2 561 882, and European Patents No. 0036 828 and 0081 901). This embodiment has a number of disadvantages - the cut-out portions or holes or projections on the front transverse edge are unsightly and dangerous and a source of dirt; the opening operation is inevitably inaccurate in nature and requires both hands (see FIG. 8 of French Patent 2 512 650); the box construction requires numerous components and excellent dimensional accuracy, thus increasing cost; and the clasp makes use of the elasticity of the constituent material, thus posing the problem of constant elasticity between different clasps for a given clasp over a period of time.

In a variant of the first embodiment, the clasps are disposed at the side (French Patents No. 2 494 970, 2 517 528 and 2 549 355). However, these boxes usually have the same disadvantages as those mentioned previously, in addition to the fact that lateral clasps are slightly less visible than a front clasp.

In a second embodiment, the box is held closed, with the cover pressing against the base, by magnetic elements (French Patents No. 2 053 956). However, this embodiment does not eliminate the projections for gripping, or the need to use both hands when opening.

In a third embodiment, the hinge comprises a resiliently deformable element (French Patents No. 2 460 850). However, this embodiment does not eliminate the previously-mentioned disadvantages, and has the disadvantage of elasticity mentioned in connection with the first embodiment.

In a fourth embodiment, the hinge is in two parts without a pivot (French Patents No. 2 512 484). However, this specification does not provide any means for holding the box closed or any specific opening means, the disadvantages being the difficulty of opening and the risk of opening accidentally.

A fifth, more recent embodiment is derived from the first embodiment already described (French Patents No. 2 534 787 and 2 538 230). The clasp, which is disposed on the front transverse edge of the box, is movable and actuated by a control member borne by a slideway extending over the main surface of the base on the inner side, the slideway terminating at the opposite side in a push rod disposed on the rear transverse edge of the box. This embodiment solves some of the problems posed by the elasticity of the material constituting the clasp. However, it has some disadvantages: the box can be only half-opened by operating the push rod, i.e. the clasp is made passive but the box is not opened completely. The user therefore has to perform two successive operations—first to actuate the push rod then to open the box completely, using both hands. The previously-mentioned risk of dirt and unsightliness are not eliminated and the amount of material used for making the box is increased, and the thickness of the box is also increased by superposing the slideway on the main surface of the base.

In a sixth embodiment, based on the fifth, the front clasp is omitted and replaced by a side of the push rod and a side of the cover which can cooperate with one another (French Patent 2 535 957). This embodiment has the advantage of eliminating the disadvantages inherent in the presence of a visible front clasp. On the other hand this embodiment requires the presence of a spring for returning the push rod, thus constituting an additional component which has the disadvantages associated with elasticity. Above all, this embodiment has exactly the same disadvantages as described in the case of the fifth embodiment with regard to operation (the box is half-opened by the push rod and then completely opened in two successive operations using both hands).

In a seventh embodiment (French Patent 2 338 671) likewise based on the fifth, the push rod also acts on a lug adjacent the cover. This embodiment theoretically has the advantage of overcoming the disadvantages of two fold operation, but in no way overcomes the other disadvantages of the fifth embodiment. Furthermore it is doubtful whether the push rod can be used for opening the front clasp and simultaneously rotating the cover; the lug is disposed perpendicular to the push rod when the cover is closed, so that when the push rod is actuated in order to open the cover the lug probably jams and is an obstacle to opening. The box has a permanent rear opening and an opening between the base and the cover. These two openings are unsightly since they show the push rod, and are also sources of dirt.

U.S. Pat. No. 2,003,355 provides a rear push rod, but combined with a resilient means which therefore has the inherent disadvantages.

U.S. Pat. No. 3,308,835 provides a front closure device and a rear closure device and also comprises a spring.

SUMMARY OF THE INVENTION

The invention aims to obviate these disadvantages and to construct a cosmetics box of per se known kind comprising a base, a pivoting cover and a pusher and without a visible resilient clasp and simultaneously capable of being completely opened by a single operation using one hand.

A second object of the invention is to construct an aforementioned cosmetics box which can be held closed or opened, for reasons of safety or comfort.

A third object of the invention is to construct an aforementioned cosmetics box which is simple in construction inter alia with the minimum number of components, minimum amount of material, without unnecessary multiple thicknesses, and with minimum use of elasticity.

A box, inter alia for cosmetics such as make-up, of the kind comprising: a base defining an upper recess for cosmetics; a cover pivotably mounted on the base around a rear transverse pivot and movable between a closed position and an open position; a movable pusher borne by the base at the rear so as to be able to slide on it, the pusher cooperating with the cover for opening it; and first means for resiliently holding the cover in the closed position and comprising two parts movable relative to one another, having complementary shapes with one another and cooperating with one another, the first part belonging to the cover; characterised in that the first part of the second holding means belongs to the base so that the push rod is mainly adapted to open the cover and not to lock it in the closed position.

According to another feature the box, which comprises a base, a cover and a pusher, is characterised in that the pivot being at least substantially coplanar with the main upper wall of the cover so as to be moved away from the main bottom wall of the base and thus to leave a free space of maximum height between the two said walls and and enable the lever and pusher to move when selectively opening and closing the cover. The box also comprises second means for resiliently holding the cover in the open position.

According to the invention, the pusher is used only for completely opening the cover, whereas the closed state is maintained independently of the push rod.

BRIEF DESCRIPTION OF DRAWINGS

The other features and advantages of the invention will be clear from the following description with reference to the accompanying drawings, in which.

DETAILED DESCRIPTION OF PREFERRED EMBODIMENT

Figure 1:
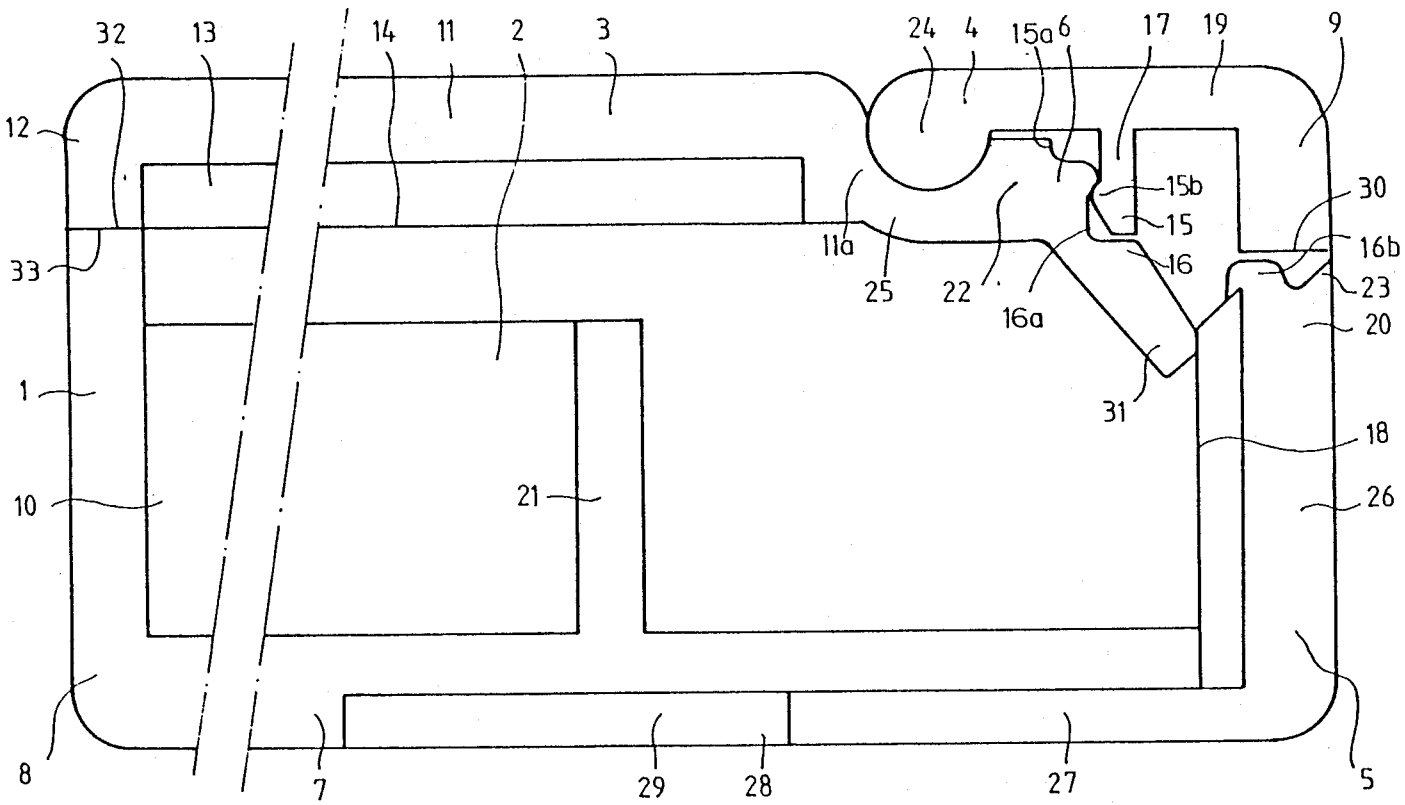
FIGS. 1 and 2 are two partial diagrammatic views in section of a box according to the invention at the position of a push rod, and closed and opened respectively.

The invention relates to a box, inter alia for cosmetics (not shown) such as make-up and essentially comprising three components, i.e. a base 1 defining an upper recess 2 at the top; a cover 3 pivotably mounted on the base 1 around a transverse rear pivot 4 and movably between a closed position ( FIG. 1) and an open position (FIG. 2); and a movable push rod 5 borne by the base 1 at the rear so as to slide with respect to the base 1 along an axis XX, the push rod 5 cooperating with the cover 3 for opening it, inter alia via a drive lever 6 adjacent the cover 3.

When closed, the box can e.g. have a general shape in the form of a flattened parallelepiped. Other shapes are possible provided they allow for the pivot 4 and push rod 5 and enable the push rod to slide. In the rest of the description, the box will be described with reference to the general parallelepipedal shape.

The box is made of plastics, inter alia hard plastics, which is made possible by the fact that the box uses practically no resiliently deformable means.

The cosmetic products or accessories are placed in recess 2, either directly or indirectly via an intermediate cup (not shown) placed in recess 2.

For convenience hereinafter, the box will be described with respect to a reference position corresponding to the normal position for use, i.e. the position where the box is closed and placed horizontally with the cover on top and opening at the front. The terms "horizontal", "vertical", "transverse", "front", "rear", etc. refer to the reference position. Of course, however, the box can be placed in other positions, particularly when closed.

The base 1 has a flat bottom horizontal main wall 7, a front vertical transverse wall 8, a rear transverse wall 9 and left and right vertical side walls 10.

The cover 3 has a flat top horizontal main upper wall 11, a rear side 11*a*, a vertical front transverse bend 12 and two vertical side bends 13 to left and right.

In the closed position, cover 3 is placed on base 1 and closes recess 2, when base 1 and cover 3 have a common joint plane 14 (FIG. 1). In the open position, cover 3 is disposed at least 90° , inter alia at an angle of the order of 100° to 120°.

The box also comprises first means 15 for holding the cover 3 in the closed position and/or second means 16 for holding the cover 3 in the open position.

The first and second holding means 15,16 comprise two parts which respectively are movable relative to one another, complementary in shape to one another and cooperate with one another, the parts being 15*a*,15*b* and 16*a*,16*b* respectively.

The pivot 4 is at least substantially coplanar with the main upper wall 11 of the cover 3 as far as possible away from the main bottom wall 7 of the base 1 and thus to leave a free space 2*b* of maximum height between the two walls 7 and 11 and enable the lever 6 and push rod 5 to move when opening or closing the cover 3.

As the preceding shows, push rod 4 is disposed towards the rear and towards the base of the box and can move along an axis XX at right angles to pivot 4, which is likewise at the rear but towards the top of the box.

The first part 15*a* of the first means 15 for holding the cover 3 closed belongs to the cover 3. The second part 15*b* of the first holding means 5 belongs to base 1, so that the push rod 5 is mainly adapted to open the cover 3 but not to lock it in the closed position.

The first holding means 15 are disposed near the pivot 4 of cover 3, inter alia in an inaccessible or masked manner, so that the other edges of the box (walls 8 and 10), inter alia the edge remote from pivot 4, are free from similar locking means.

Push rod 5 is mounted for sliding freely on base 1, inter alia without interposition of a component such as a return means. Normally therefore, the axis XX along which the push rod slides is disposed horizontally and longitudinally, i.e. it extends between walls 8 and 9 and parallel to walls 10.

More specifically, the first and second parts 15*a*,15*b* are two protuberances borne respectively by the drive lever 6 and by a rib 17 adjacent the base 1.

The lever 6 is such that when the cover 3 is in the closed position the lever is inclined with respect to the front drive surface 18 of the push rod 5 so as firstly to help the lever 6 to slide on the front surface 18 during rotation of lever 6 after opening the cover 3 and secondly to prevent the lever 6 from jamming against the front surface 18 of the push rod 5 and thus preventing the cover 6 from opening.

The lever arm D of lever 6 is e.g. at least three times the total thickness E of the box, inter alia between about 0.4 and 0.6 times the thickness E.

The base 1 has an upper horizontal bend 19 adjacent the rear transverse wall 9 and formed with a aperture 20 complementary in shape with the push rod 5 so as completely to mask the lever 6 when the cover 3 is closed and establish visual continuity between the base 1, the push rod 5 and the cover 3.

As will be seen later, the bend 19 and wall 11 of cover 3, when in the closed position, are at least substantially co-planar and in line with one another.

The lever 6 as a whole is inclined at an angle between about 90° and 180° with respect to the main top wall 11 of the cover 3, more particularly by an angle between 120° and 150° inter alia equal to or near 145° so that when the cover 3 is in the open position, the lever 6 extends substantially forwards and towards the main bottom wall 7 of the base 1 and extends between the cover 3 and an intermediate transverse vertical wall 21 adjacent the base 1 inter alia the bottom wall 7, so as firstly to completely mask the push rod 5 and secondly to establish visual continuity between the cover 3 and the intermediate transverse vertical wall 21. The intermediate transverse wall 21 is situated near and in front of pivot 4. Wall 21 is not higher than the joint plane 14 and preferably extends below this plane. Wall 21 divides recess 2 into two compartments, i.e. a front main compartment 2*a* extending between walls 8,21 carrying the cosmetic products and accessories, using an intermediate cup if required as already stated, and a rear compartment 2*b* extending between walls 9 and 21. Compartment 2*b* is also bounded by push rod 5 at the rear end base and by pivot 4 and bend 19 at the top. Recess 2*b* is basically a free space enabling push rod 5 to slide along axis XX and lever 6 to rotate around pivot 4.

The two parts 16*a*,16*b* of the second means 15 for holding the cover open belong respectively to cover 3 and to push rod 5.

More particularly, the first part 16*a* of the second holding means 16 is situated at the base 22 or near the base 22 of the drive lever 6 and inter alia comprises a recess or projection, whereas the second part 16*b* is disposed at least near the upper transverse edge 23 of push rod 5 and inter alia comprises a corresponding projection or recess.

Pivot 4 is defined by a rounded protuberance 24 from base 1 or cover 3 cooperating with a complementary annular sector 25 of cover 3 or base 1 respectively.

More particularly, protuberance 24 is formed on base 1 and the annular sector 25 is formed on cover 3 between its upper main wall 11 and the actuating lever 6.

More specifically, protruberance 24 is the front limit of bend 19, and protruberance 24 and sector 25 are mounted for gentle friction against one another.

Push rod 5*a*, in right cross-section, has a generally L-shape with two arms of substantially equal length, i.e. a vertical arm 26 and a horizontal arm 27.

Thus, the drive lever 6 is adjacent the upper main wall 11 of cover 3, towards the rear, via the annular sector 25. Sector 25 and lever 6 are disposed substantially inside the box, so that pivot 4 is situated on the rear side 11*a* of cover 3. Sector 25 serves two purposes, i.e. as the female component of shaft 4 and the support for lever 6. The opening angle of sector 25 is equal to the angle of inclination of lever 6 with respect to the main upper wall 11. This angle enables sector 25 to cooperate with protuberance 24 to form a hinge omitting rotation around pivot 4; and also ensures that lever 6 is at a suitable inclination for optimum operation.

The angle is inter alia between about 120° and 150°. Cover 3 extends over the entire opening of base 1, i.e. between walls 10, or alternatively over only a part of the opening, the other part being masked by one or more upper horizontal bends of base 1. Pivot 4 can extend transversely across the entire width of cover 5 between bends 13. This feature, combined with the embodiment of pivot 4 (protuberance 24 and sector 25) enables cover 3 to be secured on base 1 in optimum manner without interfering with the internal space needed for the movement of push rod 5 and lever 6.

There can be a number of embodiments of push rod 5 it can extend over almost the entire width of the box between the two walls 10 or can be narrower, i.e. located in the central vertical plane of the box or in a different plane. It may also be in a number of parts rigidly secured together. In all cases, it is mounted so that it can slide freely on base 1, using slide means 29, more particularly of the projection and groove type, inter alia the horizontal arm 24 of rod 5 and a cut-out portion 28 of wall 7 of base 1. The slide means 29 comprise front and rear external abutments limiting the sliding travel of push rod 5 between two end positions.

The rear transverse wall 9 of base 1 is formed with an aperture 20 adjacent the main wall 7 and continuous with the cut-out portion 28 to allow movement of push rod 5. Preferably the upper transverse edge 30 of aperture 20 corresponding to edge 23 of push rod 5 is situated near the bend 19 so as to give the maximum size to the vertical arm 26, thus giving purchase for the finger during the opening operation. The result is a portion of rear transverse wall 9 adjacent the bend 19. The bend 19 which is co-planar with cover 3 in the closed position, and the aperture 20 complementary to the push rod 5 are designed so that the box has a continuous outer surface without projections or recesses.

A vertical transverse rib 17 extending towards the wall 7 and adjacent the bent 19 near pivot 4 is formed with a protruberance 15*a* at its end, and the facing base 22 of lever 6 is formed with a complementary protruberance 15*b*, constituting first means 15 for holding the cover 3 in the closed position.

Preferably the upper transverse edge 23 of push rod 5 forms a corner cut off towards the interior of the box, on the side of the front drive surface 18, where a projection 16*b* cooperates with a complementary projection 16*a* formed inter alia in the immediate neighbourhood of projection 15*a* inter alia between it and pivot 4. The two projections 16*a*,16*b* constitute the second means for resiliently holding the cover 3 open.

The push rod 5 is freely slidably mounted between two end positions, i.e. a retracted inoperative position and an inserted operative position corresponding to the closed and open positions of cover 3 respectively, the sliding travel of the push rod substantially corresponding to the space between the vertical transverse rear wall 9 of the base 1 and the pivot 4 of the cover 3.

When rod 5 is in the retracted operative position, the first holding means 15 are operative and lever 6 is inclined at an angle to push rod 5; more specifically the rounded free end 31 of lever 6 remote from base 22 is in contact with the front driving surface 18 near the transverse edge 23. In this position, push rod 5 is continuous with base 1 at aperture 20 and cut-out portion 28, via its arms 26 and 27 respectively. The push rod is locked in this position by the holding means 15 and a rear abutment of the sliding means 10. The degree of clamping by the holding means 15 is such that cover 3 cannot open accidentally and even a slight pressure on the push rod is insufficient to separate the projections 15*a*,15*b* and consequently open the cover 3 (FIG. 1). In this position, the first holding means 15 are operative and the second holding means 16 are inoperative.

Figure 2:
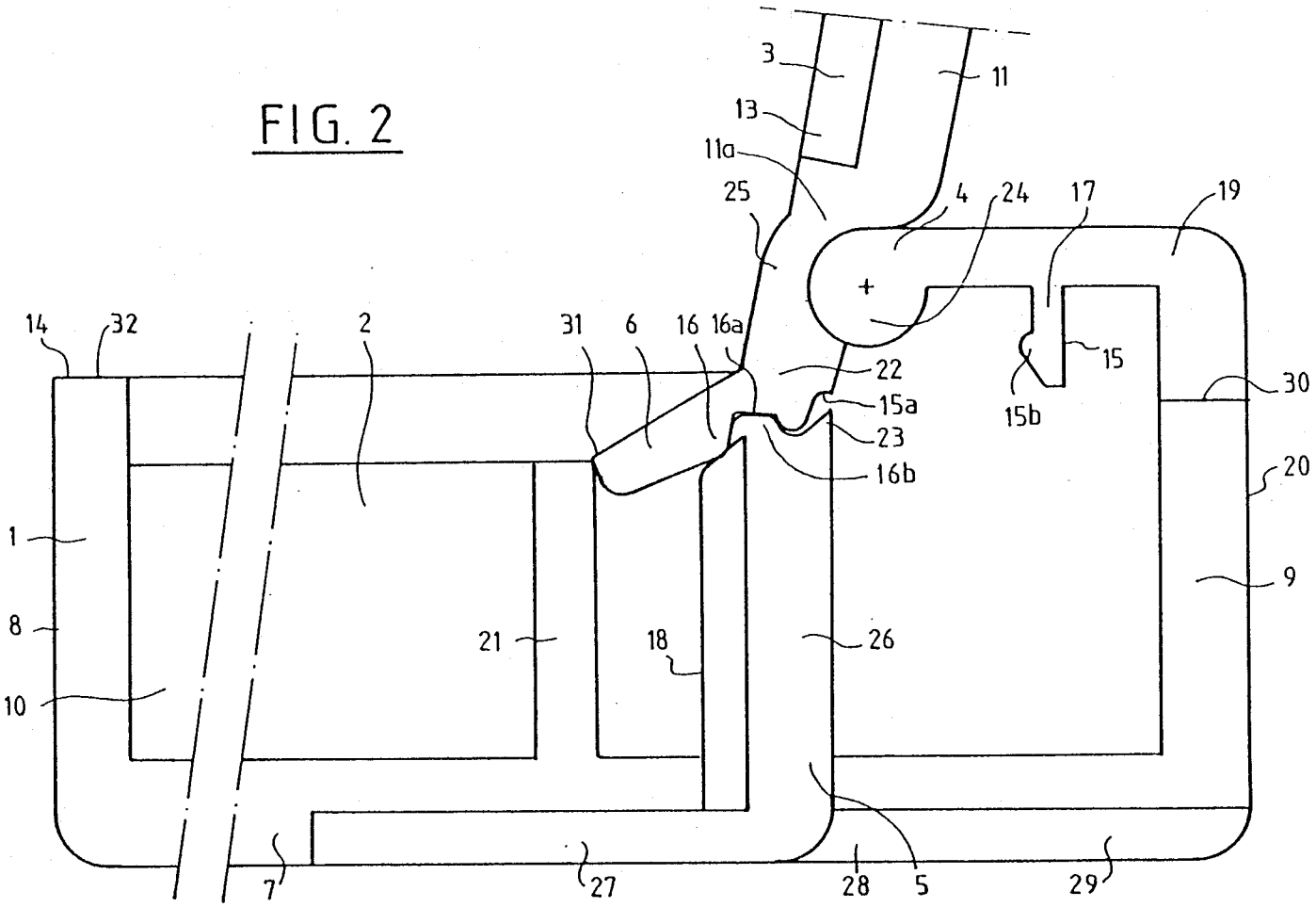

When rod 5 is in the inserted active position, the first holding means 15 are inoperative and the second holding means 16 are operative. The main wall 11 of cover 3 is inclined to the main wall 7 of base 1 by an angle of at least 90°, preferably between 110° and 120°. In this position, lever 6 is inclined from back to front and downwards between cover 3 and wall 21. For example, the lever is at an angle of about 45° to wall 7 (FIG. 2).

In the intermediate position (i.e. between the external retracted inoperative position and the external inserted operative position) the first and second holding means 15,16 are inoperative.

The vertical arm 26 of rod 5 cooperates with lever 6, whereas the horizontal arm 27 is slidably mounted on the cut-out portion 28. The length of horizontal arm 27 is limited to serving the purposes of guiding and sliding only, and consequently the cut-out portion 28 is likewise of limited length compared with the width of the box between the front and rear walls 8,9. This feature enables a limit to be put on the amount of matter used and the excess thicknesses.

As the preceding shows, the free edges 32,33 of the base 1 and the cover 3 adapted to cooperate with one another in the joint plane 14 when the cover 3 is closed, are free from projections or cavities or closing or opening means.

I claim:

1. A box for cosmetics, comprising:

a base defining an upper recess for receiving cosmetics and having front and rear transverse walls, a rear transverse pivot, a main bottom wall, and a main upper wall, said rear transverse pivot comprising a rounded protuberance and said rear transverse wall having an aperture formed therein and having a bend formed therein upwardly of said aperture and adjacent said rounded protuberance and said bend having extending therefrom in proximity to said rounded protuberance a vertical transverse rib extending downwardly toward said main bottom wall, said rib having a rib protuberance at the end thereof;

a cover having a main upper wall and a rear side, said rear side having formed therein an annular sector cooperating with said rounded protuberance, said cover being pivotably mounted on said base around said rear transverse pivot and movable between a closed position and an open position and said bend in said rear transverse wall of said base being coplanar with said main upper wall of said cover when said cover is in said closed position;

a movable pusher slidably carried by said base, said aperture in said rear transverse wall being complementary in shape with said pusher; and a drive lever extending from said rear side adjacent said annular sector inside said box and cooperating with said pusher, said drive lever being inclined with respect to said upper main wall of said cover at an angle of between approximately 120° and 150°, said drive lever having a drive lever base facing said rib and said drive lever base having a lever protuberance complementary to said rib protuberance, said rib protuberance and said lever protuberance comprising closing means for holding said cover in said closed position.

2. The box of claim 1, further comprising opening means for holding said cover in said open position and an intermediate transverse vertical wall extending upwardly from said main bottom wall of said base;

wherein said pusher is freely slidable between a first, retracted, inoperative position and a second inserted, operative position corresponding to said closed and open positions of said cover, respectively, the sliding path of said pusher substantially corresponding to the space between said rear transverse wall of said base and said pivot; and wherein when said pusher is in said retracted, inoperative position, said closing means is operative and said drive lever is obliquely inclined with respect to said pusher, and when said pusher is in said inserted, operative position, said opening means is operative and said main upper wall of said cover is inclined with respect to said main bottom wall of said base by an angle of at least 90°, said drive lever being inclined forwardly and downwardly between said cover and said intermediate transverse vertical wall.

3. The box of claim 1, wherein said base further comprises front and rear walls and said main bottom wall of said base has a cut-out portion therein; and wherein said pusher in right cross-section has an L-shape and comprises a vertical arm and a horizontal arm, said vertical arm cooperating with said lever and said horizontal arm slidably mounted in said cut-out portion and having a limited length with respect to the length of said base between said front and rear walls.

4. The box of claim 1, the free edges of said base and said cover form a smooth and continuous surface when said cover is closed.

* * * * *